United States Patent [19]

Weiss et al.

[11] Patent Number: 4,563,264

[45] Date of Patent: Jan. 7, 1986

[54] METHOD OF DRY DISTILLATION OF VOLATILE SUBSTANCES FROM MINERAL MATTER CONTAINING SAME

[75] Inventors: Hans J. Weiss, Oberursel; Roland Rammler, Königstein; Helmut Hahn, Hanau; Ingo Dreher, Oberursel, all of Fed. Rep. of Germany

[73] Assignee: Metallgesellschaft Aktiengesellschaft, Frankfurt am Main, Fed. Rep. of Germany

[21] Appl. No.: 581,083

[22] Filed: Feb. 17, 1984

[30] Foreign Application Priority Data

Feb. 22, 1983 [DE] Fed. Rep. of Germany ..... 3305994

[51] Int. Cl.[4] ..... C10G 1/00; C10G 1/02

[52] U.S. Cl. ..... 208/11 R; 201/31; 208/8 R

[58] Field of Search ..... 208/8 R, 11 R; 201/31, 201/14

[56] References Cited

U.S. PATENT DOCUMENTS

| | | | |
|---|---|---|---|
| 3,265,608 | 8/1966 | Crawford | 208/11 R |
| 3,577,338 | 5/1971 | Gifford, II | 208/11 R |
| 3,597,347 | 8/1971 | Ellington, Jr. | 208/11 R |
| 3,655,518 | 4/1972 | Schmalfeld et al. | 208/11 R X |
| 3,672,069 | 6/1972 | Reh et al. | 34/20 |
| 3,703,442 | 11/1972 | Rammler et al. | 201/12 |
| 3,925,190 | 12/1975 | Whitcombe et al. | 208/11 R |
| 4,110,193 | 8/1978 | Gwyn et al. | 208/11 R |
| 4,210,492 | 7/1980 | Roberts | 208/8 R X |
| 4,226,699 | 10/1980 | Nutter | 208/11 R |
| 4,268,359 | 5/1981 | Rammler et al. | 201/31 |
| 4,318,798 | 3/1982 | Albrecht et al. | 208/11 R |
| 4,377,465 | 3/1983 | York | 208/11 R |
| 4,384,947 | 5/1983 | Van Zanten | 208/11 R |
| 4,396,490 | 8/1983 | York | 208/11 R |
| 4,415,432 | 11/1983 | York | 208/11 R |

*Primary Examiner*—D. E. Gantz
*Assistant Examiner*—Glenn A. Caldarola
*Attorney, Agent, or Firm*—Karl F. Ross; Herbert Dubno

[57] ABSTRACT

The dry distillation of oil shale and like volatilizable materials as carried out by intimately mixing it with a fine-grain hot heat-transfer medium. According to the invention the hot distillation residue is passed in direct heat exchange with a cooling gas and the latter is utilized as one component of a preheating mixed gas which is passed in uniflow with the devolatilizable material through at least one riser. Hot combustion gases can make up other components of these mixed gases.

13 Claims, 2 Drawing Figures

METHOD OF DRY DISTILLATION OF VOLATILE SUBSTANCES FROM MINERAL MATTER CONTAINING SAME

FIELD OF THE INVENTION

Our present invention relates to a method of dry distillation for the extraction of bituminous substances and oil from mineral matter containing same, and more particularly, to a process for the dry distillation of bituminous or oil containing solids

BACKGROUND OF THE INVENTION

Distillation can be used for the recovery of bituminous substances and oil from bituminous or oil containing mineral matter which, to the extent that the hydrocarbons can be driven from the mineral matter, can be referred to as "devolatilizable material."

Such materials include oil shale, oil sand, coal, diatomaceous earth or mixtures of these with other mineral substances and, more generally, to solid mineral matter containing volatile hydrocarbons.

The term "dry distillation" or terms of similar significance can be used to describe a process in which the mineral matter to be subjected to the dry distillation is brought into direct contact with a solid heat carrier so that a solid-solid heat transfer is effected with the bituminous or hydrocarbon components being volatilized from the devolatilizable mineral matter.

Known processes for the dry distillation treatment of such mineral substances and which contact these mineral substances with a hot fine-grain heat-transfer medium, are described in German Pat. Nos. 1,809,874 and 1,909,263, in German patent document (open application) DE-OS No. 29 27 065 and in U.S. Pat. Nos. 3,655,518, 3,703,442 and 4,318,798.

The efficiency and economy of these processes can be increased by preheating the devolatilizable mineral matter by waste heat.

U.S. Pat. No. 3,265,608 describes the dry distillation of oil shale in which the devolatilizable mineral matter is mixed with the heated granular material from another source, i.e. a different material, to vaporize the oil. The heating of the granular material is effected by combustion of a fuel, and from the combustion process an exhaust gas arises which is utilized to preheat the oil shale in a riser, i.e. in an upright duct through which the oil shale is passed.

Notwithstanding the progress represented by the aforementioned patents and publications in the dry distillation of bituminous and oil-containing mineral matter, the economies of the processes leave much to be desired and afford considerable room for improvement with the aim of ensuring that the processes will be economical.

OBJECTS OF THE INVENTION

It is, therefore, the principal object of the present invention to provide an improved dry-distillation process for the purposes described which has improved energy efficiency and hence which is more economical than the prior art processes.

Another object of this invention is to provide a process for the dry distillation of devolatilizable material, especially oil shale, oil sand, coal and diatomaceous earth, which is free from drawbacks present in earlier processes.

Still another object of the invention is to provide an improved method of increasing the thermal economy and energetic efficiency of such dry distillation processes.

SUMMARY OF THE INVENTION

The dry-distillation process with which the present invention is concerned is one in which a hot fine-grain heat-transfer medium is circulated and in a pneumatic conveyer is heated to a temperature of about 600° to 900° C. in direct contact with hot combustion gases before being conveyed to a collecting bin from which it flows to a distillation zone in which it is mixed with fresh devolatilizable material, i.e. the bitumen or oil containing mineral matter described above to heat the latter to a temperature of about 450° to 800° C. From above, the resulting mixture, so-called overhead gases and vapors, released by the dry distillation heat of the devolatilizable mineral matter, are recovered, withdrawn and further processed.

According to the invention, hot distillation residue, i.e. the mineral matter from which the hydrocarbons have been liberated, is passed in a cooling zone in direct contact with a gas (cooling gas) to heat the latter. This now-heated heat-transfer gas is mixed with hot combustion gas from the collecting bin and the gas mixture is utilized to dry and preheat the mineral matter in an operation in which the latter, i.e. the devolatilizable material, is conveyed through at least one riser and in uniflow with the movement of the devolatilizable material, i.e. with movement of the heat-transfer gas and the mineral matter through the riser codirectionally. Thereafter, this preheated devolatilizable material at a temperature of 70° to 250° C. is fed to the distillation zone in which the distillation process proceeds in the manner previously described.

The distillation residue which is supplied to the cooling zone may be withdrawn directly downstream of the distillation zone by branching of or a portion of it from the outflow of the distillation zone or can be withdrawn from the collecting bin.

The distillation residue leaving the distillation zone usually contains residual carbon which can be burned to a significant extent in the pneumatic conveyer delivering it to the collecting bin. For this reason it has been found to be most advantageous and a feature of the invention to use the collecting bin as a source of all or most of the distillation residue which is supplied to the cooling zone.

We have also found that it is advantageous, and hence an important feature of the invention, to conduct air as the cooling and heat-transfer gas through the cooling zone and to adjust the oxygen content in the gas mixture so that it is at most about 15% by volume in the mixed gas. This heat-transfer gas with its reduced oxygen content can be supplied to the hotter one of two risers in which the direct contact between the heat-transfer gas and the devolatilizable material is carried out to ensure an adequate margin of safety over the explosion limit of the devolatilzable material.

The temperature of the mixed gas may be adjusted in various ways. For example, the hot combustion gas can be indirectly cooled in a controllable manner before it is admixed with the cooling gas. For increased economy, part of the mixed gas leaving the riser may be reused to preheat devolatilizable material by recycling it and/or by separately contacting it with the devolatilizable material.

It has been found to be advantageous to effect the preheating in at most two risers or rising pipe lines although effective results can be obtained when only one such riser is used. Limiting the number of risers in this way minimizes the capital investment in the preheating of the devolatilizable material.

Advantageously, about 10 to 100% by volume, and preferably 20 to 50% by volume of the mixed gas supplied to the riser is constituted by the heat-transfer or cooling gas derived from the cooling zone. When it is desired to reduce the oxygen content in the cooling gas to a minimum value, the gas leaving the cooler operating riser is preferably recycled for such dilution purposes. Any dust contained in this dilution gas can be removed, preferably in a dust collector such as an electrostatic precipitator before the dilution gas is supplied to the cooling zone.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
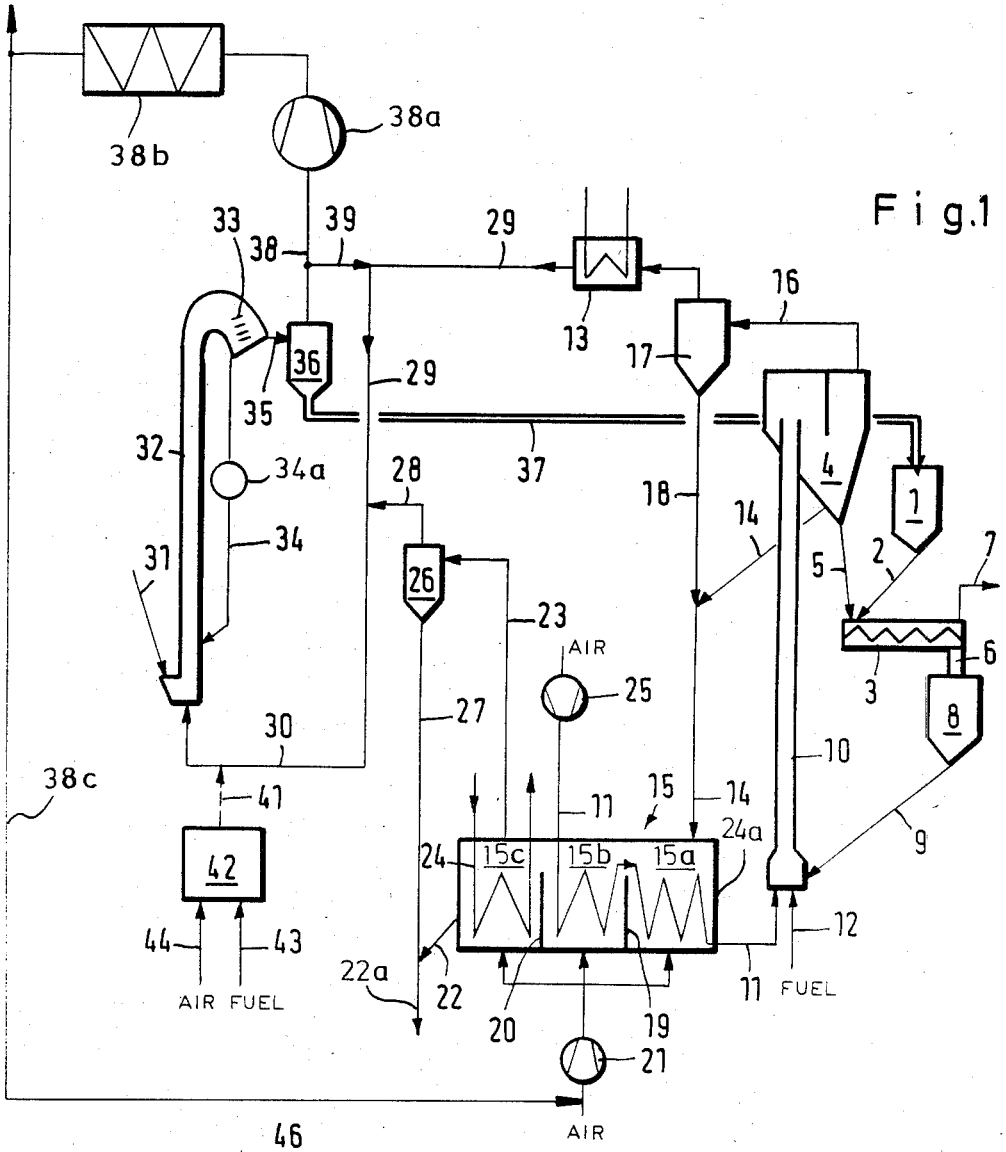
FIG. 1 is a flow diagram illustrating an apparatus utilizing a single preheating stage for carrying out the process of the invention.

In FIG. 1 we have shown a supply bin from which preheated devolatilizable material is fed via a line 2 to a mixer 3 which is supplied via line 5 with hot distillation residue from a collecting bin 4. The materials, after being intimately combined in the mixer, are delivered via a discharge line to a holding bin 8, overhead gases and vapors being withdrawn from line 7 for further processing, e.g. by condensation, to recover valuable components of the distilled vapors.

From the holding bin 8 the solids are carried via line 8 to the pneumatic conveyer 10 fed at its lower end via line 11 with heated combustion air and, if greater amounts of thermal energy are required, with a fuel which is supplied via line 12 to burn in the combustion air. The fuel can be a liquid or gaseous hydrocarbon.

The combustion air is sufficient to burn off substantial hydrocarbon residues in the mineral matter within the pneumatic conveyer 10 that lifts the hot residues into the collecting bin 4. A portion of the hot distillation residue is withdrawn as represented via line 14 and is cooled in a cooling zone 15. Hot combustion gases are withdrawn from the collecting bin via line 16, are passed through a dust-collecting cyclone 17 and then through a waste-heat boiler 13.

The solids from the cyclone 17 are combined at 18 with the solids fed to the cooling zone.

The cooling zone 15 comprises a multichamber fluidized bed cooler provided with partitions 19 and 20 or serves as the fluidizing gas and is forced by the blower 20 into the apertured floors of the respective cooling chambers.

The multichamber fluidized-bed cooler can be of the type described in German Pat. Document No. 19 09 039 and U.S. Pat. No. 3,672,069.

In this case, the fluidizing gas also serves as a cooling gas and while being fluidized or held in suspension in the fluidizing gas, the solids are caused to move gradually from the entrance zone proximal to line 14 to an exhaust zone or chamber with which the solids outlet 22 communicates In other words, the solids pass in succession from the chamber **15*a* through the chamber 15*b* to the chamber 15*c***.

The thermal energy and a sensible heat of the solids is thus utilized to heat the fluidizing and cooling gas which leaves the cooling zone via line 23 With the cooling coils 24 which are immersed in air surrounded by the fluidized bed in the cooler, water vapor (steam) can be generated while other coils, e.g. as shown at **24*a*** can be utilized to heat combustion air.

To this end, a blower 25 can feed the combustion air through the coils **24*a* and ultimately to line 11** which has been mentioned previously.

From the cooling gas which leaves the fluidized bed via line 23, dust can be removed via the cyclone 26 and collected solids can be withdrawn via line 27 and together with the cooled distillation residue from line 22 can be discharged at **22*a*** for discard e.g. by dumping or for further treatment.

The heated cooling gas or heat-transfer gas is carried from the cyclone 26 via line 28 and is mixed with hot combustion gas from line 29, i.e. gas leaving the waste heat boiler 13 The resulting gas mixture or mixed gases are carried by line 30 to the preheating stage as will be described in greater detail below. The hot combustion gas of line 29, of course, is derived from the cyclone 17 for the waste heat boiler 13. The temperature and heat content of the mixed gases in line 30 is sufficient to enable these gases to dry and preheat the devolatilizable material.

The mixed gases in line 30 are at a temperature of 350° C. to 750° C. and are delivered to a riser 32 at the base thereof. The riser 32 or the rising pipeline, conducts the devolatilizable material introduced as shown by line 31, upwardly, i.e. codirectionally with the direct heat-exchange gas or in uniflow therewith If the usable heat content of the mixed gases in line 30 is not sufficient for the desired drying and preheating of the devolatilizable material, then hot combustion gas from line 41 is admixed therewith before it enters the riser 32. The combustion gases in line 41 are formed by burning in a combustion chamber 42 supplementary fuel supplied by line 43 with combustion air supplied by line 44. The supplementary fuel may consist of fuel gas or fuel oil recovered by condensation or cooling of the vapor or gaseous products recovered at 7. Naturally, other fuel gas, oil or coal may be used for this purpose.

The use of the combustion chamber 42 to develop a hot gas is advantageous also for the startup and shutdown of the dry distillation operation because in these cases it allows decoupling of the preheating of the oil shale from the dry distillation.

The upper end of the riser 32 is provided with louver blades represented diagrammatically at 33 and forming an adjustable air separator or sifter so that coarse devolatilizable material with a selected particle size range is recycled at an adjustable rate to a lower portion of the riser for recontacting with the mixed gases and therefore assurance with even deeply trapped volatizable substances will be released by the deep penetration of heat to the larger or coarse grain fraction The recycling line 34, which can be a tubular chute can be provided with a grinder, disintegrater or comminuter to reduce the coarse grain fraction if desired. The disintegrater has been shown at **34*a* in FIG. 1**.

The devolatilizable material of sufficient fine grain and preheated to the desired degree is entrained by the mixed gases flowing through the air separator 33 via line 35 into a cyclone 36 and from the latter the preheated devolatilizable material is conveyed by transfer line 37 to the supply bin 1. The heat transfer gas is in part exhausted from the cyclone 36 by a blower via line 38, the blower being represented at 38*a*, while another portion can be diverted to line 39 and recycled to line 29 as part of the mixed gases. The gas in line 38 which is not recycled can be passed through an electrostatic precipitator 38*b* or some other appropriate dust-collecting unit. Some or all of this dust-free gas may be recycled at 38*c* to the blower 21 for use as cooling gas.

In the apparatus of FIG. 1, the preheated devolatilizable material from the bin 1 is delivered to the mixer 3 at a temperature of 70° to 220° C. and the hot distillation residue at line 5 may have a temperature of 600° to 900° C.

Figure 2:
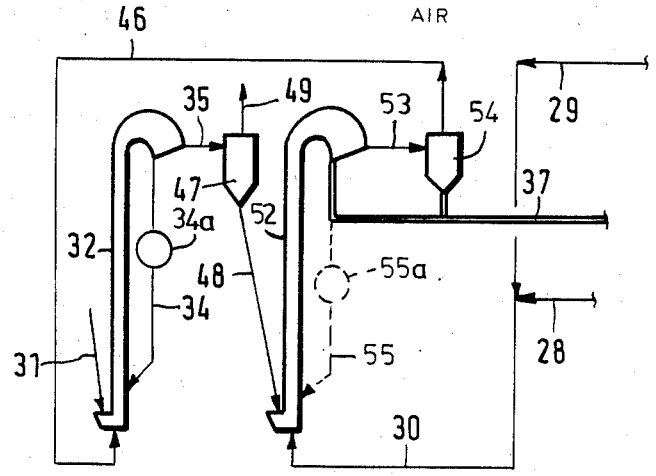
FIG. 2 is a diagram of the preheating stage of such an apparatus utilizing two preheating risers.

In the embodiment of FIG. 1 only a single preheating riser is used. In the embodiment of FIG. 2, however, which is otherwise identical to that of FIG. 1, two preheating risers 32 and 52 are used.

The fresh devolatilizable material is fed through line 31 to the riser 32 in the manner previously described and the hot mixed gases from line 30 are supplied to the second riser 52 at the base thereof. The gas leaving the riser 52 at its top flows via line 53 to a cyclone 54 from which collected solids are delivered to the transfer line 37 previously described, this line receiving coarser solids from the preheating riser directly while another portion of the coarse grain solids can be returned e.g. at 55 via a disintegrater 55*a* to the base of the riser 52. Generally the recycling line 55 and the disintegrater 55*a* are not necessary.

The gases withdrawn from the cyclone 54 are delivered via line 46 to the riser 32 in which they pass in uniflow with the fresh devolatilizable material to initially preheat the latter and this material is delivered at line 35 with possible recycling of the coarse grain fraction at line 34, to the cyclone 47. The latter separates the solids from the gas and the gas is discharged at 49, e.g. to a blower as shown at 38*a*, an electrostatic precipitator 38*b* and the recycling line 38*c*. The solids are further preheated by being delivered via line 48 to the bottom of the riser 52 in which the solids pass in uniflow with the mixed gases from line 30 in the manner described

SPECIFIC EXAMPLES

Example 1

Two process embodiments A and B are carried out in a pilot plant as shown in FIG. 1. In embodiment A, oil shale which contains 1% by weight moisture is supplied to the rising pipeline 32; the oil shale processed in the process embodiment B contains 12% by weight moisture The pilot plant has a rising pipeline 32 having a height of 25 meters and an inside diameter of 0.2 meter, the line 39 is closed and the combustion chamber 42 is not operated In operation, the following steady-state conditions are obtained on the basis of a throughput of 1 metric ton of oil shale (on an anhydrous basis). In the following data t stands for metric ton.

| | | | |
|---|---|---|---|
| Hot mixed gases in line 30 | $m^3/h$ | 525 | 610 |
| | °C. | 400 | 500 |
| Oil shale in line 37 | t/h | 1.0 | 1.04 |
| | °C. | 150 | 90 |

-continued

| | | | |
|---|---|---|---|
| Mixed gases in line 38 | $m^3/h$ | 537 | 727 |
| | °C. | 180 | 130 |
| Combustion gas in line 16 | $m^3/h$ | 340 | 411 |
| | °C. | 670 | 670 |
| Hot distillation residue in line 14 at inlet of cooling zone 15 | kg/h | 800 | 800 |
| | °C. | 670 | 670 |
| Distillation residue through line 5 | t/h | 3.4 | 4.5 |
| | °C. | 670 | 670 |
| Distillation residue in line 9 | t/h | 4.2 | 5.3 |
| | °C. | 520 | 520 |
| Distillation residue in line 22 | kg/h | 776 | 776 |
| | °C. | 200 | 200 |
| Fluidizing air through blower 21 | $m^3/h$ | 185 | 199 |
| | °C. | 30 | 30 |
| Air in line 23 | $m^3/h$ | 185 | 199 |
| | °C. | 400 | 400 |
| Air through blower 25 | $m^3/h$ | 317 | 387 |
| | °C. | 30 | 30 |
| Air in line 11 at inlet of conveyor 10 | $m^3/h$ | 317 | 387 |
| | °C. | 450 | 450 |
| Steam produced in line 24 from boiler feed water at 100° C. | kg/h | 73 | 55 |
| | °C. | 180 | 180 |
| | bars | 10 | 10 |
| Combustion gas in line 29 at outlet of waste heat boiler 13 | $m^3/h$ | 340 | 411 |
| | °C. | 400 | 538 |
| Water vapor produced in waste heat boiler 13 from boiler feed water at 100° C. | kg/h | 54 | 32 |
| | °C. | 180 | 180 |
| | bars | 10 | 10 |

All volume data, also in Example 2, relate to standard conditions, i.e. 0° C. and 1.013 bars. In both process embodiments the volume of the fluidized bed in the cooling zone 15 in the fluidized state is 0.4 $m^3$. The oil shale in line 37 is perfectly dry in process embodiment A and still contains 4% residual moisture in process embodiment B.

Because oil shale at a higher temperature and with a lower moisture content is fed to the mixer 3, the output of the dry distillation plant is increased by 21% in process embodiment A and by 37% in process embodiment B.

Example 2

The oil shale of process embodiment A of Example 1 is charged to the modified pilot plant which is shown in FIG. 2 and in other respects corresponds to FIG. 1 and Example 2. The following steady-state conditions are obtained for a throughput of 1 metric ton of oil shale (on an anhydrous basis) in line 31:

| | Rate (per hour) | Temperature °C. |
|---|---|---|
| Mixed gases in line 46 | 525 $m^3$ | 206 |
| Oil shale in line 48 | 1 t | 100 |
| Mixed gases in line 30 | 525 $m^3$ | 400 |
| Oil shale in line 37 | 1 t/h | 186 |
| Mixed gases in line 49 | 537 $m^3$ | 130 |
| Hot distillation residue in line 14 at inlet of cooler 15 | 800 kg | 670 |
| Distillation residue in line 5 | 3.2 t | 670 |
| Distillation residue in line 9 | 4.0 t | 520 |
| Distillation residue in line 22 | 776 kg | 200 |
| Fluidizing air through blower 21 | 201 $m^3$ | 30 |
| Air in line 23 | 201 $m^3$ | 400 |
| Air through blower 25 | 301 $m^3$ | 30 |
| Air in line 11 at inlet of conveyor 10 | 301 $m^3$ | 455 |
| Steam at 10 bars produced in line 24 from boiler feed water at 100° C. | 73 kg/h | 180 |
| Combustion gas in line 29 at outlet of waste heat boiler 13 | 324 $m^3$ | 400 |
| Steam at 10 bars produced in waste heat boiler 13 from boiler feed water | 50 kg | 180 |

-continued

| | Rate (per hour) | Temperature °C. |
|---|---|---|
| at 100° C. | | |

The oil shale in line 37 is prefectly dry. Owing to the preheating in two stages in Example 2, the oil shale is preheated to a temperature which is 36° C. higher than in process embodiment A of Example 1. In Example 2 the output of the dry distillation plant is increased by 27% over that achieved in an operation in which the oil shale in line 2 was not preheated and contained 1% by weight moisture.

We claim:

1. A process for subjecting mineral matter containing bituminous or oil volatile substances and constituting devolatilizable material, to dry distillation which comprises the steps of:

(a) drying and preheating the devolatilizable material in a preheating zone while conveying the same upwardly through at least one riser in direct contact with heat-exchanging mixed gases at a temperature of 350° to 750° C. whereby said mixed gases and devolatilizable material during the preheating thereof pass in uniflow through said riser;

(b) mixing the devolatilizable material from said preheating zone in a distillation zone having a temperature of about 70° to 250° C. with a hot fine-grain heat transfer medium at a temperature of about 600° to 900° C. to heat said devolatilizable material in said distillation zone to a temperature of about 450° to 800° C. and expel volatile substances therefrom in the form of overhead gases and vapors;

(c) recovering said overhead gases and vapors from said distillation zone whereby a hot solid distillation residue is formed upon the release of said volatile substances from said devolatilizable material, withdrawing said distillation residue from said distillation zone and feeding a part of it to a pneumatic conveyor, in said conveyor producing combustion gases and by means of said combustion gases heating said distillation residue and conveying it upwardly to a collecting bin, from said collecting bin feeding at least part of said distillation residue as said hot fine-grain heat transfer medium to said distillation zone, from said bin withdrawing said combustion gases;

(d) feeding hot distillation residue into a cooling zone and fluidizing and cooling said distillation residue therein by direct contact with a cooling gas, said hot distillation residue in said cooling zone being supplied at least in part from said bin or from said distillation zone;

(e) combining at least a first and a second component to produce said mixed gases, said first component being said cooling gas withdrawn from said cooling zone and said second component being said combustion gases from said bin, the temperature of said mixed gases being 350° to 750° C.; and (f) feeding the mixed gases formed in step (e) to step (a) for the preheating of said devolatilizable material.

2. The process defined in claim 1 wherein the hot distillation residue in said cooling zone is supplied at least predominantly from said bin.

3. The process defined in claim 3 wherein said cooling gas is air and is supplied as said one component, further comprising the step of controlling the oxygen content of the mixed gases supplied to said riser so that the oxygen content is less than 15% by volume therein.

4. The process defined in claim 3 wherein the devolatilizable material is preheated in two such risers in succession and traverses a relatively low temperature riser initially and a high temperature riser subsequently, the oxygen content of the mixed gases being fed to the higher temperature riser being maintained below 15% by volume.

5. The process defined in claim 1 wherein the second component of the mixed gases formed in step (e) is hot combustion gas which is cooled indirectly before it is mixed with said one component.

6. The process defined in claim 1 wherein a heated combustion air is supplied to said pneumatic conveyer for the combustion of combustibles to heat said heat-transfer medium.

7. The process defined in claim 1 wherein said combustion air is heated indirectly in said cooling zone.

8. The process defined in claim 1, further comprising the steps of recovering mixed gases from the devolatilizable material at the top of said riser and utilizing the recovered mixed gases to heat an additional quantity of devolatilizable material at least in part.

9. The process defined in claim 1 wherein said devolatilizable material is preheated by passing same in succession through two risers, said mixed gases being fed directly to a second of said risers traversed by said devolatilizable material, being recovered from the top of the second riser, and being fed to the bottom of a first of said risers to be traversed by said devolatilizable material.

10. The process defined in claim 9 wherein 10 to 100% of the mixed gases supplied to a riser is constituted by gas heated in said cooling zone.

11. The process defined in claim 1 wherein 10 to 100% of the mixed gases supplied to a riser is constituted by gas heated in said cooling zone.

12. The process defined in claim 1 wherein at least a portion of low temperature gas recovered from a riser for the preheating of devolatilizable material is fed to said cooling zone as at least a part of said cooling gas.

13. The process defined in claim 9 wherein at least a portion of low temperature gas recovered frcm a riser for the preheating of devolatilizable material is fed to said cooling zone as at least a part of said cooling gas.

* * * * *